United States Patent [19]

Elgersma

[11] 4,086,577

[45] Apr. 25, 1978

[54] GUARD MONITOR SYSTEM

[76] Inventor: Henry J. Elgersma, 4631 Northview NE., Grand Rapids, Mich. 49505

[21] Appl. No.: 595,558

[22] Filed: Jul. 14, 1975

[51] Int. Cl.[2] ..... G07C 1/20

[52] U.S. Cl. ..... 340/306; 340/309.1; 340/309.4

[58] Field of Search ..... 340/306; 346/86, 134

[56] References Cited

U.S. PATENT DOCUMENTS

| | | | |
|---|---|---|---|
| 2,084,097 | 6/1937 | Long | 346/86 |
| 2,389,345 | 11/1945 | Dell | 346/86 |
| 2,968,521 | 1/1961 | Gross | 346/134 |
| 3,736,561 | 5/1973 | Rumpel | 340/306 |
| 3,774,193 | 11/1973 | Restrepo | 340/306 |

*Primary Examiner*—Harold I. Pitts

*Attorney, Agent, or Firm*—Price, Heneveld, Huizenga & Cooper

[57] ABSTRACT

The specification discloses a guard monitoring system having remote guard stations to be activated in a predetermined order. Station activation causes a control circuit to activate a recording device and to be operatively connected to the next station in the predetermined order.

17 Claims, 5 Drawing Figures

GUARD MONITOR SYSTEM

BACKGROUND OF THE INVENTION

1. Field of the Invention

This invention involves a security patrol system.

2. Prior Art

There are a variety of known means to acknowledge the presence at predetermined locations of a guard who is assigned the task of investigating those locations. Typically, the locations are scattered throughout a building so that the guard must walk through essentially all of the building to reach all of the predetermined locations. The most prevalent system, probably for economic reasons, involves a guard carrying a time clock which he punches with differently coded keys channeled to different monitoring stations. Such a system is cumbersome, but has been the industry standard for years.

In some applications, this archaic system is totally unacceptable. For example, in prisons or jails, it is dangerous for a guard to carry a heavy time clock since he may be attacked by a prisoner and bludgeoned with his own clock.

To overcome such objections and to streamline guard monitoring systems, prior artisans have suggested remote units placed at the monitoring locations and connected to a central monitoring control system. The prior art teaches various specific apparatus having such remote guard stations and central control systems, but none have achieved any apparent commercial success.

U.S. Pat. No. 3,237,183 issued to R. F. Eagan on Feb. 22, 1966 teaches a monitoring system in which the guard energizes relays associated with each station as he proceeds with the tour. When the tour has been completed, all of the relays will be latched in the energized position. The system is then reset by pressing a switch which cuts off power and the relays become de-energized. U.S. Pat. No. 2,559,746 issued to L. F. B. Ahlberg et al. on July 10, 1951 discloses a control station with circuitry connected to relays associated with guard stations and to a recording device. The recording device includes an electromagnet with an associated writing pen in a recording instrument. When a relay is released by the watchman breaking the contact at the control station, the recording device is activated.

The Eagan and Ahlberg et al. patents both have an involved central control system connected with each of the remote stations. Each of the guard stations requires an associated plurality of relays and current paths to determine the presence of a guard at any of the stations. Each additional component adds to the complexity and cost of fabrication, reduces reliability, and adds to the space required for installation of the system.

U.S. Pat. No. 2,298,840 issued to G. G. N. Purcell on Oct. 13, 1942 discloses an alarm system in which a portable transmitter carried by a watchman is inserted into a transmitting station to transmit signals characteristic of each station to connected control equipment. U.S. Pat. No. 1,394,838 issued to C. C. Johnson et al. discloses a portable register which is actuated each time a watchman reaches a station. When the watchman reaches the end of a tour, he may connect suitable transmitting mechanism within his register to a suitable circuit and may then send a signal indicating he has completed the tour.

The Purcell and Johnson et al. patents add the additional complexity of a portable device to be carried by the guard and used at each guard station. An interaction between the central control system associated with each guard station and the portable device provides the indication of the guard at the particular station. The addition of the portable device adds to the cost of the system and adds components which may fail to perform properly. Also, there still remains a plurality of relays and current paths associated with each guard station.

Thus, attempts to modernize guard monitoring systems have resulted in complicated and expensive electronic nightmares. They have achieved no apparent successes.

SUMMARY OF THE INVENTION

The present invention comprises a greatly simplified electronic monitoring system which maintains central control over the sequence of activation of the guard stations and eliminates the conventional time clock. Essentially, there is only a single control means which is sequentially connected to the guard stations as they are to be activated. There is a switching means at each guard station to be operated by the guard, a first switching means to connect the central control means to the selected guard station, and a second switching means in the control means to activate an indicating or recording means. The switching means in the control means is particularly advantageous because of the way a transistor, biased by a parallel combination of a transistor and capacitor, is used to perform the switching function.

The invention also teaches a recording means capable of recording time and date information when a guard station is activated. The recording means itself provides for automatic activation in response to the switching means of the control means and for an automatic gravity feed advance of the recording medium in preparation for the next activation.

A guard monitoring system in accordance with an embodiment of this invention includes a control circuit selectively connected to any one of a plurality of guard stations and controlling the operation of a recording device. The control circuitry includes a recording device. The control circuitry includes a transistor having a parallel combination of a capacitor and a resistor connected between the collector and the base of the transistor. This capacitor-resistor combination controls the flow of current through a resistor connected between the base and the emitter of the transistor. Accordingly, the voltage between the base and the emitter of the transistor is controlled and thereby the conducting or nonconducting state of the transistor is controlled. When the transistor conducts, the recording device is activated to indicate the presence of the guard at the station. More specifically, activation of a guard at the station. More specifically, activation of capacitor into the control circuit and permits current flow through the biasing resistor thereby biasing the transistor into a conducting state. Current through the transistor flows through a relay which then activates the recording device.

In an embodiment of this invention, the recording device is a punch clock with a gravity feed. The punch clock is activated and an indication printed on a recording card every time a station is activated by the guard. The recording card in the punch clock is automatically positioned by gravity after station activation for receiving the next indication of station activation. In accordance with an embodiment of this invention, the card itself does not in any way provide for activation of the punch clock and acts as the recording medium of sequential activations of the punch clock.

The control circuitry of the guard monitoring system, including the transistor and the resistor-capacitor parallel combination, is selectively connected in a predetermined sequence to each of the guard stations thereby avoiding a repetition of the control circuitry. Such lack of repetition within a system means that there are fewer assembly steps, there are fewer parts required and the total cost of labor and parts for the system is reduced. Also, the elements that are used in a system in accordance with an embodiment of this invention are relatively easily obtained and assembled into a completed system.

DETAILED DESCRIPTION OF THE PREFERRED EMBODIMENT

Figures 1, 2:
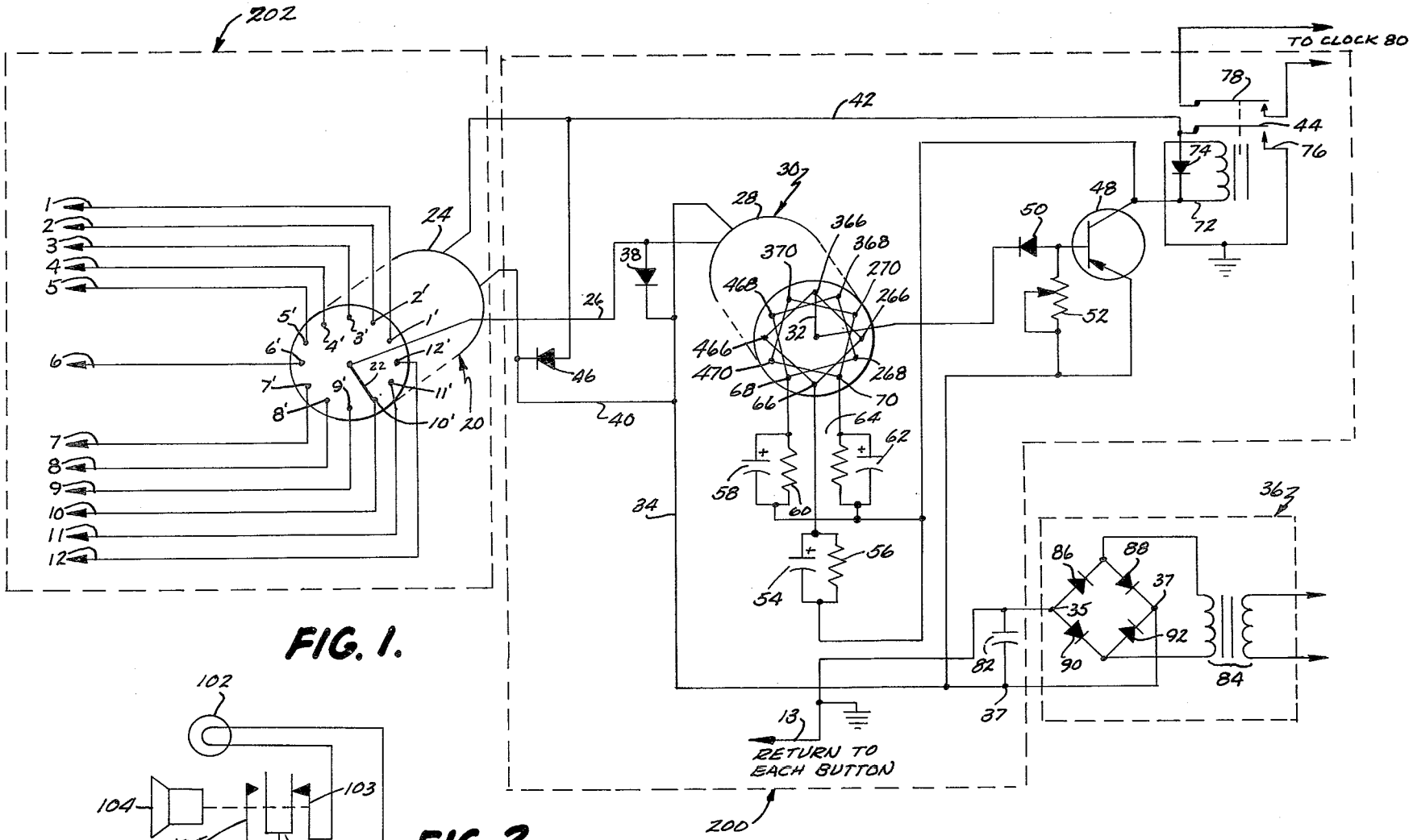
FIG. 1 is a schematic diagram of a guard monitoring system in accordance with an embodiment of this invention.
FIG. 2 is a schematic diagram of a guard station.
Figure 5:
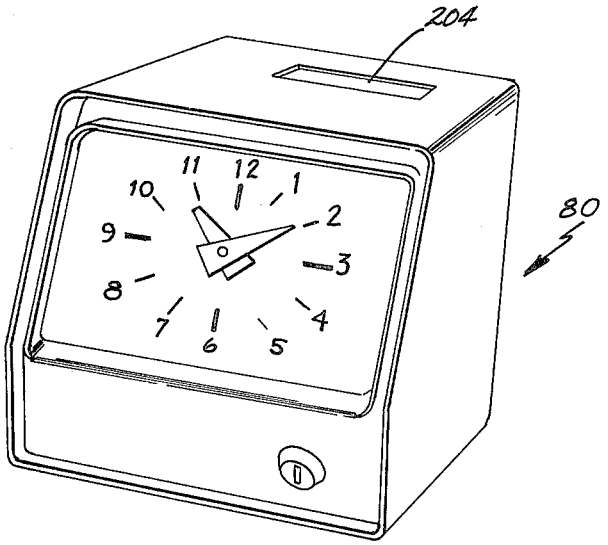
FIG. 5 is a perspective view of a punch clock having a vertical gravity feed in accordance with an embodiment of this invention.

Referring briefly to FIGS. 1, 2 and 5, a guard monitoring system in accordance with an embodiment of this invention includes a central control circuit 200, a plurality of guard stations each including a switch 100 and indicator lamp 102, sequential switching means 202 selectively connecting the control circuitry to the guard stations, and a punch clock 80 connected to control circuitry 200. The guard stations are activated in a specified order and each activation includes recording the time of activation of the station and connection of central control circuit 200 using sequential switching means 202 to the next guard station to be activated. Once central control circuit 200 is connected to a guard station, activation of that station closes a transistor switch for a predetermined time to initiate recording of time and to activate sequential switching means 202.

Referring to FIG. 1, switching means 202 of the guard monitoring system includes electrical connections to each of a plurality of remote guard stations. In accordance with this embodiment having 12 such guard stations, conductors 1-12 are used to individually couple each guard station to switching means 202 and, in turn, to control circuit 200. Additionally, a ground conductor 13 couples all of the guard stations to the control circuitry. A first rotary stepping switch 20 is connected to each of connections 1–12 at switch contacts 1′–12′respectively. A rotating central arm 22 is mechanically rotated to selectively electrically connect to any of switch contacts 1′–12′. An electrically actuated stepping motor 24 forming an integral part of rotary switch 20 is mechanically connected to rotating arm 22.

A typical power supply 36 includes a full wave bridge rectifier circuit and a transformer 84 connected on one side to an external 60 Hz A.C. voltage source. A diode 86 and a diode 88 are connected in series between terminals 35 and 37. Additionally, diodes 90 and 92 are connected in series between terminals 35 and 37. The other side of transformer 84 from the A.C. voltage side is connected to intermediate points between diodes 86 and 88 and diodes 90 and 92. Accordingly, the diode arrangement acts as a rectifying circuit to produce a direct current output at terminals 35 and 37. Typically, terminal 37 is positive with respect to terminal 35. Advantageously, a capacitor 82 connected between terminals 35 and 37 of power supply 36 helps to smooth and reduce any variations in magnitude of the direct current.

Central control circuit 200 includes an electrical conductor 26 coupling rotating arm 22 of switch 20 to an electrically actuated stepping motor 28 of a second rotary stepping switch 30. Drive 28 rotates a rotating arm 32 of the second rotary switch 30. A direct voltage power supply 36 having an output terminal 37 is coupled to drive 28 of rotary switch 30 by a conductor 34. A diode 38 is coupled between conductors 26 and 34 coupled to drive 28. Similarly, a conductor 40 couples terminal 37 of power supply 36 to supply operating power to drive 24 of rotary switch 20. The remaining terminal of drive 24 is coupled to a relay operated switch 44. A diode 46 is connected between connection 42 and conductor 40. Diodes 38 and 46 permit rapid discharging of any coils within the electrical drives of the rotary switches.

A PNP transistor 48 has an emitter terminal coupled to terminal 37 of power supply 36 and a base terminal coupled to rotating arm 32 of switch 30 by a diode 50. The base of transistor 48 is also coupled to the emitter of transistor 48 by a variable resistor 52. The collector of transistor 48 is coupled in parallel to each of three combinations of a resistor and a capacitor coupled in parallel and to one terminal of a relay coil 72 associated with switch 44. The remaining terminal of coil 72 is grounded.

The parallel RC combinations include a capacitor 54 and a resistor 56, a capacitor 58 and a resistor 60, and a capacitor 62 and a resistor 64. Each of the parallel combinations of a capacitor and a resistor is connected to a different stationary contact of switch 30. Thus, the first combination including capacitor 54 and resistor 56 is coupled to contact 66, the second combination including capacitor 58 and resistor 60 is coupled to a contact 68, and the third combination including capacitor 62 and resistor 64 is coupled to a contact 70. Each contact 66, 68 and 67 is in turn coupled to every third switch contact as one progresses around the contacts of rotary switch 30. Thus, contact 66 is coupled to contacts 266, 366 and 466, contact 70 is coupled to contacts 270, 370 and 470 and contact 68 is coupled to contacts 268, 368 and 468. Such an arrangement permits a different one of the RC networks to be sequentially coupled in the base to collector circuit of transistor 48 for the reason set forth below.

The collector terminal of transistor 48 is also connected to a terminal 35 of power supply 36 through a relay coil 72 having a magnetic core. Double pole single throw switch contacts 44 and 78 are associated with relay coil 72 and are actuated to close upon actuation of coil 72. A diode 74 is connected across coil 72 to permit discharging of induced currents. A terminal 76 associated with switch 44 is coupled to ground. Switch 78 is electrically serially coupled to clock 80.

Referring to FIG. 2, a typical guard station includes a double pole double throw (DPDT) push button switch 100 with break before make contacts for illuminating lamp 102 and a station switching means to complete a circuit which activates clock 80. The stationary contacts 101 of switch 100 are coupled to the appropriate corresponding stationary contacts of rotary switch 20. One movable arm 103 is coupled to lamp 102 having its remaining terminal coupled to ground while the remaining movable arm 105 is coupled to ground. A push botton 104 associated with switch 100 is used by the guard for the momentary actuation of the switch. Pressing button 104 couples power supply 36 to drive 28 of rotary switch 30 and lamp 102 is illuminated whenever rotating central arm 22 of switch 20 is coupled to the stationary contact of the switch corresponding to the guard station containing the lamp.

Figure 3:
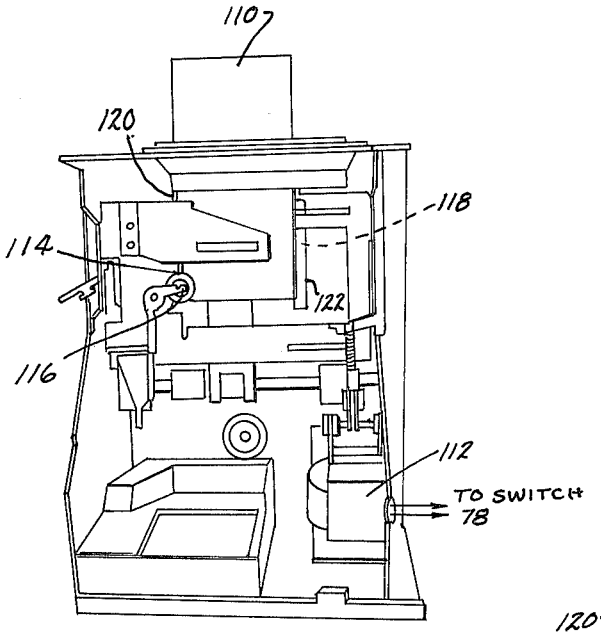
FIG. 3 is an interior view of a punch clock in accordance with an embodiment of this invention.
Figure 4:
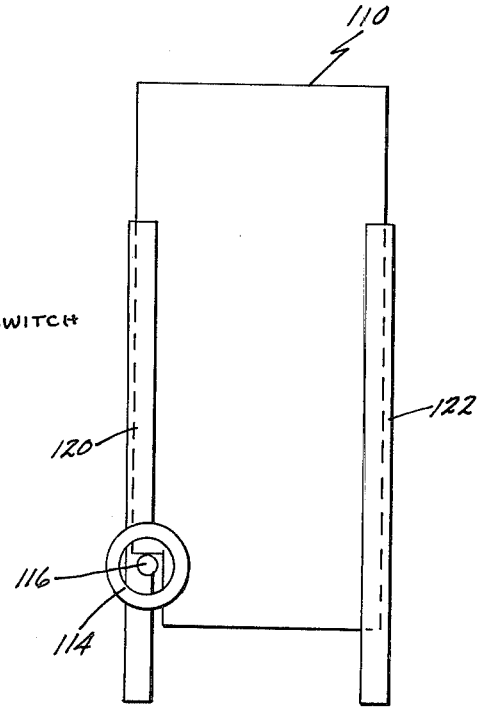
FIG. 4 is a front elevation view of a punch card and selected portions of the punch clock in accordance with an embodiment of this invention.

Referring to FIG. 5, there is illustrated an exterior view of a commercially available punch clock 80 having a slot 204 for a vertical gravity feed of a punch card. FIGS. 3 and 4 show selected interior views of punch clock 80. Typically, in the prior art, the insertion of a card into a punch clock activates a switch which activates a solenoid thereby punching out a portion of the card and imprinting the time on the card. However, in accordance with an embodiment of this invention, a solenoid 112 is directly connected to switch 78 associated with relay coil 72 to be actuated upon the actuation of transistor 48. Further, there are no switches which are activated by the insertion of card 110. As a result, whenever switch 78 is closed and solenoid 112 is activated, a hole is punched in card 110 within a circle 114 and the card advances further down in preparation for the next punch. The downward movement of card 110 is limited by a fixed support 116. A time printing assembly 118 (FIG. 3) imprints time and date information on card 110. Guides 120 and 122 on either side of card 110 guide the vertical movement of card 110.

OPERATION

The system includes a plurality of guard stations which are to be activated in a specified order as the guard makes his rounds. A station ready to be activated has lamp 102 illuminated. To activate a station, the guard pushes button 104 of switch 100 and thereby activates punch clock 80 back at a central location, such as a guard house, which stamps card 110 (FIG. 4) and causes card 110 to advance downwardly in clock 80. After the guard has pushed the button, the station lamp 102 associated with the station is extinguished and a lamp associated with the next station in the specified order is activated. Transistor 48 is biased in a nonconductive mode and between station actuations by the guard, the capacitor which is connected between the collector and the base of transistor 48 is in a steady state charged condition. Also, between activations rotating arm 22 is connected to the contact of rotary switch 20 associated with the guard station to be activated next.

More specifically, when a guard pushes button 104, conductor 26 of drive 28 for rotary switch 30 is electrically connected to ground conductor 13. Since conductor 34 from drive 28 is connected to terminal 37 of power supply 36, a voltage is applied to the drive 28. As a result, rotating arm 32 is stepped one position to the next contact. This couples a different parallel combination of a capacitor and a resistor between the base and the collector of transistor 48. It can be appreciated that the capacitor which is connected between the base and the collector of transistor 48 is in an uncharged state because it has discharged through its associated resistor during the time it was out of the circuit.

Having connected an uncharged capacitor between the collector and base of transistor 48, current from power supply 36 can flow through resistor 52, through diode 50, through the capacitor and resistor parallel combination, for example capacitor 62 and resistor 64, through coil 72 and return to power supply 36.

Current flowing through resistor 52 produces a voltage drop across resistor 52 which biases transistor 48 into conduction. Accordingly, there is a current path formed from power supply 36 through the emitter-collector current path of transistor 48 and through coil 72 back to power supply 36. This is a relatively low resistance path and significantly increases the current flowing through coil 72. The increased current through coil 72 produces a magnetic field which attracts and closes switches 44 and 78. Closing switch 78 activates clock 80 to punch the time on the card and to punch a section out of card 110 so it feeds down to its next position. In particular, when switch 78 closes, an external power source supplying clock 80 is electrically connected to a punching mechanism which punches out a portion of card 110. Closing switch 44 couples power supply 36 across drive 24 of rotary switch 20. Rotating arm 22 is moved one position and thus sequenced to the contact associated with the next guard monitoring station. Connection of arm 22 to the next guard monitoring station activates lamp 102 at that station.

Since capacitor 62 remains connected between the collector and the base of transistor 48 until the next guard station is activated, it charges to a steady state value and eventually current through capacitor 62 ceases. The voltage across associated resistor 64 is determined by the current flowing from power supply 36 through the series combination of resistor 52 and resistor 64. Advantageously, the magnitude of the series resistor combination is large enough so the voltage drop across resistor 52 is insufficient to bias transistor 48 into conduction. Typically, this means that the resistors associated with each capacitor are larger than resistor 52 and are chosen with respect to the particular operating characteristics of transistor 48 and the magnitude of resistor 52. As a result, transistor 48 is biased into a nonconducting region and current in the emitter-collector path of transistor 48 stops. The current continuing in coil 72 is insufficient to maintain switches 78 and 44 closed and they open to remove power from switch 20 and clock 80.

Any of the capacitors which are not connected between the base and the collector of transistor 48 are discharged by the parallel resistor associated with each capacitor. As is well-known, the time of this discharge is determined by the associated RC time constant. The time constant should be short enough so the capacitor is essentially discharged when the capacitor-resistor combination is again incorporated into the circuit by rotary switch 30. However, as noted above, the resistor associated in parallel with each capacitor must be of a sufficiently large magnitude so 1) steady state current through resistor 52 is not sufficient to bias transistor 48 into a conducting state and 2) steady state current through coil 72 is not sufficient to produce a magnetic attraction to retain switches 44 and 78 in a closed position. Accordingly, the value of the resistor is important. The RC time constant can also affect the number of parallel capacitor-resistor combinations that are necessary. That is, if the capacitor can discharge in the time between successive guard station activations, then only two parallel combinations are necessary. On the other hand, if guard station activations are rapid, more than three parallel combinations may be necessary.

Diode 50 prevents the capacitor connected between the base and collector of transistor 48 from discharging through resistor 52 limiting its discharge to its associated parallel resistor. Similarly, diode 74 across coil 72 permits rapid discharging of coil 72 and prevents undesired discharging of coil 72 through power supply 36 and transistor 48.

A typical capacitor for use as capacitor 54, 58 or 62 has a magnitude of 5 μF and is suitable for use at 50 V D.C. Associated resistors 56, 60 and 64 can have a typical value of about 22 Kohms and have a power rating of about ½ watt. Variable resistor 52 can be a 100 ohm variable resistor with a power rating of about 1 watt. Capacitor 82 across the terminals of power supply 36 can advantageously have a magnitude of about 2,000 μF and be suitable for use at 50 V D.C. A commercially available punch clock which can be modified to be configured and operate in accordance with an embodiment of this invention is the Amano fully automatic consecutive spacing time recorder series 6500 (NR-7X). The clock is modified to permit gravity feed of a vertical card with a possible 30 positions to time stamp. In accordance with the preferred embodiment of the invention disclosed herein, only 12 positions are utilized corresponding to the 12 stations utilized. Modifications to the clock include removal of all integral microswitches which are activated by the insertion of a card into the clock and would complete a circuit to activate a solenoid. As discussed above in accordance with an embodiment of this invention, solenoid 112 is directly activated by switch 78. To permit unrestricted gravity feed of card 110, tension springs holding card guides against the card are loosened.

Various modifications and variations will no doubt occur to those skilled in the various arts to which this invention pertains. For example, the mechanical rotary switches may be replaced by electronic switching mechanisms. The activation of the push button by the guard at the guard monitoring station may include the use of a key. Appropriate polarity changes can be made so an NPN transistor can be used. These and all other variations which basically rely on the teachings through which this disclosure has advanced the art are properly considered within the scope of this invention as defined by the appended claims.

The embodiments of the invention in which an exclusive property or privilege is claimed are defined as follows.

1. A guard tour system including a plurality of guard stations and a central control coupled to said guard stations for receiving and recording signals indicating the actuation of switch means at each of the guard stations by a guard on tour said system comprising:

a plurality of guard station switch means for guard stations to be actuated by a guard at a station; and a control system including first switch means for responding to activation of one of said plurality of guard station switch means and for sequencing to another of said plurality of guard station switch means in response to activation of one of said plurality of guard station switch means; means for sequentially coupling said first switch means to each of said switch means associated with the guard stations; power supply means coupled to said first switch means; a control switch and biasing delay means coupled to said control switch for actuating said control switch; said biasing delay means sequentially coupled to and uncoupled from said control switch by said first switch means so said control switch is momentarily actuated to close by the actuation of said first switch means; recording means; means coupling said recording means to said control switch for recording each of the actuations of said control switch; and means for deactuating said biasing delay means permitting successive momentary actuation of said control switch when a guard actuates a different guard station means.

2. The system as defined in claim 1 wherein said delay means comprises a charge storage means and a discharging means for removing charge from the charge storage means, and said control switch comprises a solid state switch.

3. The system as defined in claim 2 wherein said means coupling said first switch means to the guard station switch means comprises a first stepping switch including an electrical drive means coupled to said solid state switch to be actuated thereby and a plurality of unique contacts each coupled with one of said guard station switch means and a wiper arm sequentially coupled to each of said unique contacts and to said first switch means.

4. The system as defined in claim 3 and further including a plurality of charge storage means each including a resistor coupled in parallel thereto for discharging an associated capacitor and said first switch means comprises a second stepping switch including an electrical drive means connected to said first sequential stepping switch and contacts coupling said charge storage means to said solid state switch.

5. The system as defined in claim 4 wherein said solid state switch comprises a transistor coupled to said power supply for receiving operating current therefor and having a base terminal coupled to said charge storage means by said second sequential stepping switch such that as said charge storage means is switched into the base circuit by said second stepping switch, said transistor is momentarily biased in a conductive mode and as said charge storage means is charged, said transistor is rendered nonconductive.

6. The system as defined in claim 5 wherein said coupling means between said solid state switch and said recording means comprises a relay having a relay coil in the collector to emitter path of said transistor defining said solid state switch and switch means associated with said relay coil and coupled to said recording means for actuation thereof.

7. The system as defined in claim 6 further comprising a lamp at the guard station for indicating the connection of the guard station to the control means.

8. A monitoring system having a control station coupled to a plurality of guard stations each with station switching means to be operated in a prescribed sequence, the system comprising:

a plurality of station switching means associated with a plurality of guard stations; and a control station including indicating means for indicating the activation and the time of activation of station switching means of a guard station, first switching means for selectively coupling one after another of the plurality of station switching means in the guard stations to said control station in accordance with said prescribed sequence so that activation of only the specific one of the plurality of station switching means so coupled to said control station is communicated to said control station during the time interval said specific one of said station switching means is coupled thereto and activation of the others of said plurality of station switching means during such time interval is not communicated to said control station, means in the control station responsive to the activation of a station switching means for activating the indicating means so that it shows that said specific one of said station switching means has been activated and the time at which such activation occurred and for sequencing the first switching means so that the next in said prescribed sequence of said station switching means is coupled to said control station, subsequent activation of said next station switching means activating said indicating means, sequencing said first switching means to couple the next of said station switching means in said prescribed sequence to said control station, said sequencing means proceeding serially through said prescribed sequence of guard station switch means as each is activated in said sequence.

9. A monitoring system as recited in claim 8 wherein said activating means includes:

a transistor having base, collector and emitter terminals;

a first resistor coupled between said emitter and base of said transistor;

a first parallel combination of a capacitor and an associated resistor coupled between said base and collector of said transistor;

a relay including contacts and an actuation coil coupled to the collector of said transistor; and power supply means coupled to said transistor for providing operating power thereto.

10. A monitoring system as recited in claim 9 further comprising:

a second parallel combination of a capacitor and an associated resistor coupled between said base and collector of said transistor; and second switching means for coupling one of said first or second parallel combinations of a capacitor and an associated resistor between the base and the collector of said transistor.

11. A monitoring system as recited in claim 10 wherein said indicating means includes recording means coupled to said relay contacts for recording information when said transistor is rendered conductive to actuate said relay.

12. A monitoring system as recited in claim 11 wherein said recording means includes a gravity feed punch clock including means for guiding a punch card into said clock support means positioned in said clock for limiting movement of the card, punching means for removing a portion of the card and imprinting means for recording information on the card when said relay contacts are closed.

13. A monitoring system as recited in claim 12 wherein the capacitor in each of the parallel combinations is about 5 $\mu$F and the resistor in each of the parallel combinations is about 22 Kohms.

14. A monitoring system as recited in claim 13 further comprising:

a relay including a clock switch for activating a card punch clock;

a solid state which coupled to said relay; and biasing means coupled to said transistor for momentary actuation of said transistor when a guard station is actuated.

15. A monitoring system as described in claim 14 wherein said biasing means includes:

a plurality of parallel combinations of a capacitor and an associated resistor for coupling between the base and the collector of said transistor;

a rotary switch for selectively coupling a combination of a resistor and a capacitor between the base and the collector of the transistor; and a resistor coupled between the base and the emitter of the transistor.

16. A monitoring system as recited in claim 15 wherein said resistor in parallel with said capacitor has a resistance significantly greater than the resistance of said resistor coupled between said base and said emitter of said transistor.

17. A monitoring system having a control station coupled by a first switching means to a plurality of guard stations with station switching means to be operated in a prescribed sequence, the system comprising:

a transistor having an emitter terminal adapted to be connected to ground;

a first resistor connected between the emitter of the transistor and the base of the transistor;

a magnetic relay coil having two terminals, one terminal being connected to the collector of the transistor and the second terminal being adapted to be connected to a power supply;

a first parallel combination of a capacitor and an associated resistor selectively connected between the base of the transistor and the collector of the transistor;

a second parallel combination of a capacitor and an associated resistor selectively connected between the base of the transistor and the collector of the transistor;

a second switching means connected in series between the transistor and the first and second parallel combinations of capacitors and associated resistors, so only one parallel combination of a capacitor and an associated resistor is connected between the base of the transistor and the collector of the transistor;

a first rotary switch, included in the first switching means having an electrical drive with two electrical drive terminals adapted to be connected to a power supply, a plurality of switch contacts so each station switching means is serially connected to a different switch contact, and a rotating arm adapted to be connected in series with the electrical drive terminals of another rotary switch and adapted to be selectively connected to one of the switch contacts of the first rotary switch;

a first drive switch electrically connected in series with the electrical drive terminals of the rotary switch and magnetically coupled to the magnetic relay coil;

a secondary rotary switch, included in the second switching means having an electrical drive with two electrical drive terminals adapted to be connected to a power supply and to be connected in series with the rotating arm of the first rotary switch, a first switch contact connected in series to the first parallel combination of a capacitor and an associated resistor, a second switch contact connected in series to the second parallel combination of a capacitor and an associated resistor, and a rotating arm connected in series with the base of the transistor and adapted to be selectively connected to one of the switch contacts;

a lamp at a guard station connected in series with a switch contact of the first rotary switch;

a lamp switch connected in series with the lamp and a switch contact of the first rotary switch for selectively completing an electrical circuit;

a station switch mechanically coupled to the lamp switch and electrically connected in series with a switch contact of the first rotary switch;

a card punch clock activated at a guard station to punch a card and to record information on the card, the clock having a vertical gravity feed for the card which advances the card to prepare the card for the next punch when the card has been punched thereby removing a portion of the card and having a support for limiting vertical movement of the card; and a clock switch operated by magnetic coupling to the magnetic relay coil and electrically connected in series with the card punch clock.

* * * * *

UNITED STATES PATENT AND TRADEMARK OFFICE

CERTIFICATE OF CORRECTION

PATENT NO. : 4,086,577

DATED : April 25, 1978

INVENTOR(S) : Henry J. Elgersma

It is certified that error appears in the above-identified patent and that said Letters Patent are hereby corrected as shown below:

Column 2, lines 43-44:
Delete "The control circuitry includes a recording device."

Column 2, line 55:
Delete "More specifically, activation of a guard at the station."

Column 2, line 56:
After "of" insert -- a guard station by the guard connects an uncharged --

Column 5, line 9:
"botton" should be -- button --

Column 10, line 1:
"which" should be -- switch --

Signed and Sealed this

*Sixth* Day of *February 1979*

[SEAL]

*Attest:*

RUTH C. MASON
*Attesting Officer*

DONALD W. BANNER
*Commissioner of Patents and Trademarks*